United States Patent [19]

Sommers

[11] Patent Number: 4,815,155

[45] Date of Patent: Mar. 28, 1989

[54] PORTABLE UNDERLYING MATTRESS STIFFENER

[76] Inventor: Clayton L. Sommers, 634 19th St., Santa Monica, Calif. 90402

[21] Appl. No.: 201,600

[22] Filed: Jun. 1, 1988

[51] Int. Cl.[4] ..... A47C 21/06

[52] U.S. Cl. ..... 5/446; 5/417

[58] Field of Search ..... 5/446, 447, 417–420

[56] References Cited

U.S. PATENT DOCUMENTS

| | | | |
|---|---|---|---|
| 2,551,976 | 5/1951 | Smith | 5/417 |
| 3,280,515 | 10/1966 | Eriksson | 5/446 |
| 4,399,574 | 8/1983 | Shuman | 5/417 |

FOREIGN PATENT DOCUMENTS

| | | | |
|---|---|---|---|
| 2402335 | 8/1974 | Fed. Rep. of Germany | 5/417 |

*Primary Examiner*—Alexander Grosz

*Attorney, Agent, or Firm*—Mason, Fenwick & Lawrence

[57] ABSTRACT

A portable mattress stiffener forming a supplemental support adapted to be placed between the mattress and underlying box springs, wherein a plurality of elongated rigid slats of relatively thin, generally rectangular cross-sectional configuration are arranged in planiform side-by-side parallel abutting relation in use position to form a rectangular panel. L-shaped hinge formations integrally formed along one side wall of each slat protrude beyond the face of the side wall and a rod portion of the opposite side wall interfits in a recess defined by the L-shaped protruding hinge formation to form hinges between the slats at their lower edges permitting the slats to be rolled up into a roll-like bundle for transport, or to be unrolled into a predetermined substantially planiform relationship with the hinge axes of the interfitting hinge formations located adjacent the lower edges of the side walls and the side walls abutting each other.

14 Claims, 4 Drawing Sheets

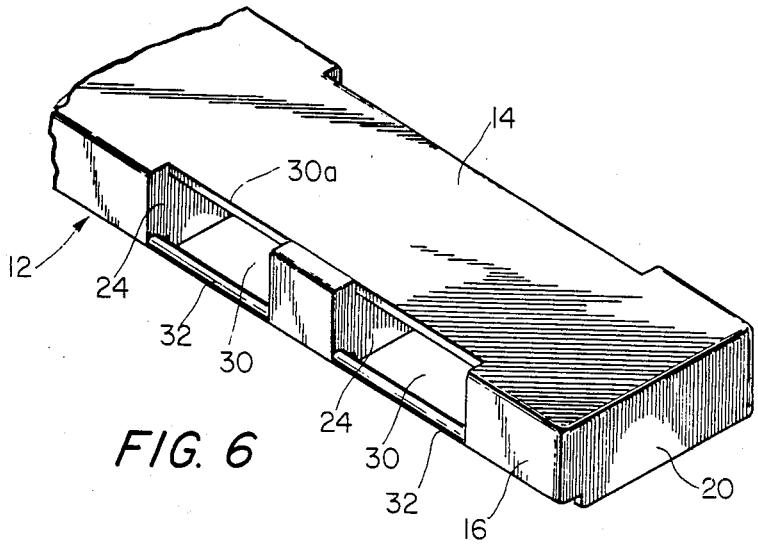
FIG. 6
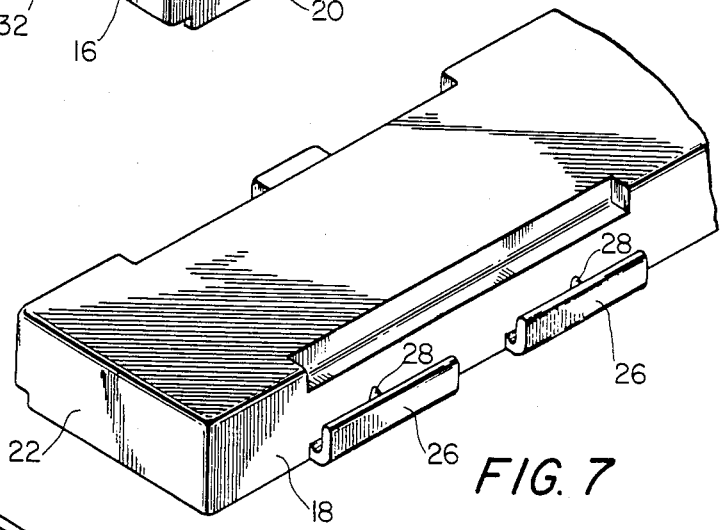
FIG. 7
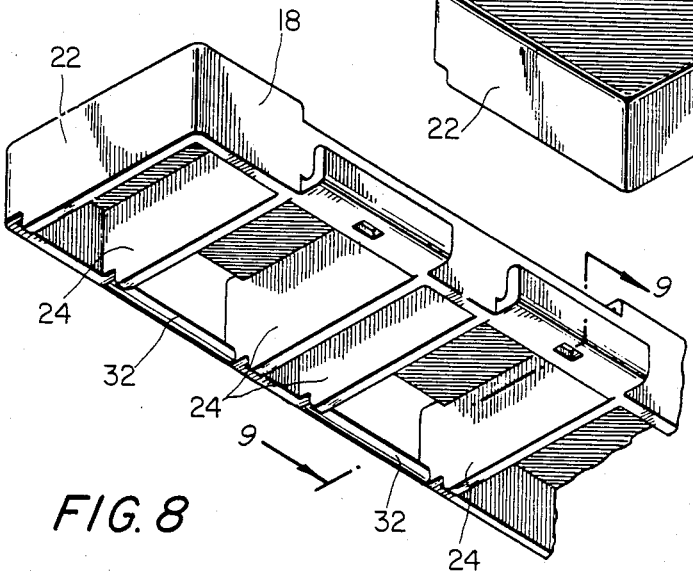
FIG. 8
FIG. 9
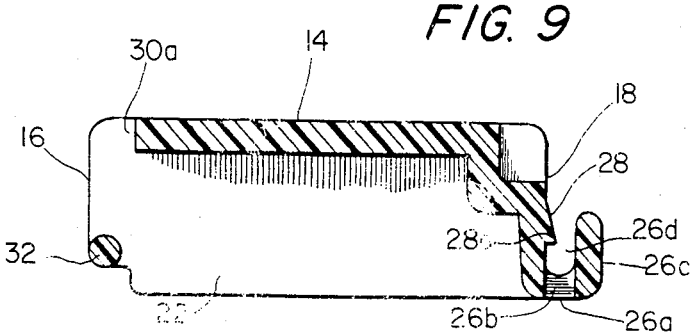

PORTABLE UNDERLYING MATTRESS STIFFENER

BACKGROUND AND OBJECTS OF THE INVENTION

The present invention relates in general to portable bed stiffeners of the type designed to be inserted between the mattress and box springs of a bed to impart additional stiffness to the mattress, particularly for use by persons with back problems requiring firmer bed mattress support. More particularly the present invention relates to portable bed mattress stiffeners of the above-identified type arranged in the form of a plurality of slats capable of being rolled into a compact roll for convenience of transportation.

Heretofore, it has been long recognized that persons suffering from back or spinal problems need firmer mattress support in beds used by such persons to minimize aching or soreness in the back or spinal region as may occur following sleeping on a bed mattress which is too soft. One of the most common aids to impart additional stiffness to a bed mattress to be used by such persons is to insert what is usually referred to as a "bed board" between the mattress and box springs, which spans a major portion of the width and length of the mattress. This is customarily simply a plywood, pressed wood, or other similar wood panel usually about one quarter to three eighths inch thick in the form of a rectangle about three feet by four feet in size.

Since such bed boards would obviously be too large and uunwieldly to be readily transportable during traveling by persons desiring to have a bed board or similar mattress with them, it has been previously proposed to subdivide such bed boards into smaller sections which are foldable to occupy a smaller space and be more readily transportable. Rickert U.S. Pat. No. 3,125,678 and Krueger U.S. Pat. No. 4,649,583 are examples of posture boards or bed boards which are foldable, and are designed to be interposed between the mattress and box springs of a bed mattress and spring arrangement. However such foldable posture boards or bed boards are still relatively large and inconvenient to transport.

A portable arrangement of cords and slats is disclosed in Smith U.S. Pat. No. 2,551,927, to facilitate transportation in a folded, compact form, and which is unfolded and placed on a mattress of a bed to provide support for osteopathic treatment, although in this arrangement the slats are designed to extend lengthwise of the bed rather than crosswise, and apparently are designed to lie on top of the mattress rather than between the mattress and the box springs.

The Eriksson U.S. Pat. No. 3,280,515 discloses a supplemental support for a bed mattress adapted to be placed beneath the mattress, in which a pair of flexible sheets are secured together to form a plurality of pockets spanning one dimension of the sheets, to receive resilient rods providing a selected amount of stiffness and imparting additional stiffness to the mattress along the longitudinal direction of the rods by adjustment of the springiness of the rods. Localized stiffness at different locations can be obtained. Similarly, U.S. Pat. No. 2,728,089 to Hynes discloses a mattress stiffener having a plurality of tubular members joined by flexible means in parallel spaced relation to one another, which also provides stiffness in the longitudinal direction of the tubular members. Flexible joined rigid slats arranged parallel to each other are also disclosed as a back rest for vehicle riding, in the Boland U.S. Pat. No. 2,745,473. However, in each of the Erickson, Heinz and Boland patents, the stiffness and resistance to distortion occur only along the longitudinal direction of the rods, tubular members or slats, and there is no resistance to distortion of the mattress support in the direction perpendicular to the longitudinal axis of the rods, tubular members or slats since they are interconnected by flexible means.

An object of the present invention is the provision of a portable mattress stiffener or supplemental support for bed mattresses adapted to be placed between the mattress and underlying box springs, which is formed of a plurality of elongated slat members of relatively thin, generally rectangular cross-sectional configuration having interfitting hinge formations on adjacent confronting side walls thereof and having abutment surfaces coactive to permit rolling up of the plural slat mattress stiffener assembly when rolled into a spiral form in one direction, and wherein the hinge and associated abutment surfaces coact when the slat assembly is unrolled to resist deformation of the hinged together slats from a predetermined substantially planar or planiform arrangement.

Other objects, advantages and capabilities of the present invention will become apparent from the detailed description, taken in conjunction with the accompanying drawings illustrating a preferred embodiment of the invention.

BRIEF DESCRIPTION OF THE FIGURES

FIG. 6 is a fragmentary perspective view of the portion of one of the slats, viewed from above and forwardly of the slat;

FIG. 7 is a fragmentary perspective view of an opposite end portion of the slat, viewed from above and rearwardly of the slat;

FIG. 8 a fragmentary perspective view of the end portion of the slat shown in FIG. 7 viewed from below and rearwardly of the slat; and FIG. 9 is a vertical transverse section view taken along the line 9—9 of FIG. 8.

DETAILED DESCRIPTION OF A PREFERRED EMBODIMENT

Figure 1:
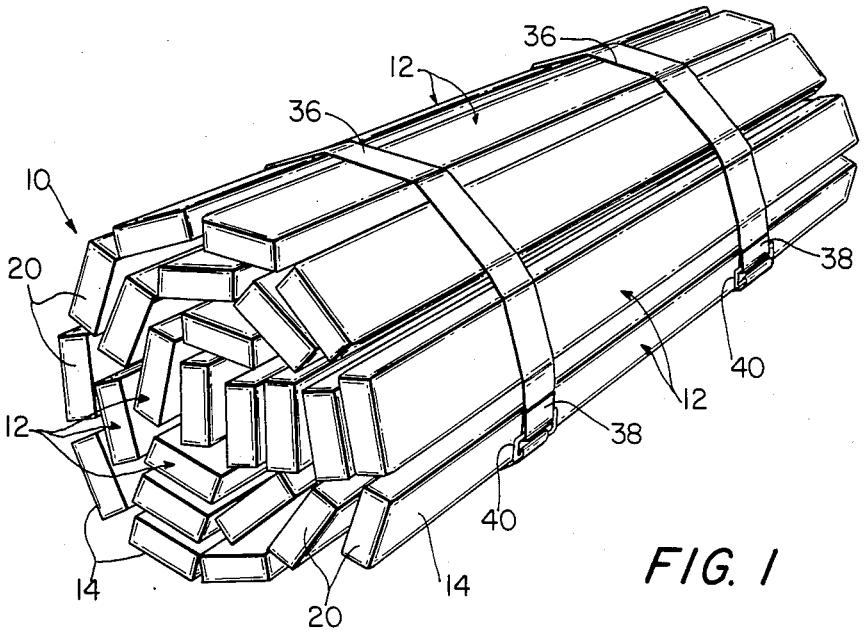
FIG. 1 is a perspective view of the portable bed mattress stiffener or supplemental support assembly of the present invention, shown rolled up in a form for convenient transport of the mattress stiffener assembly.
Figure 2:
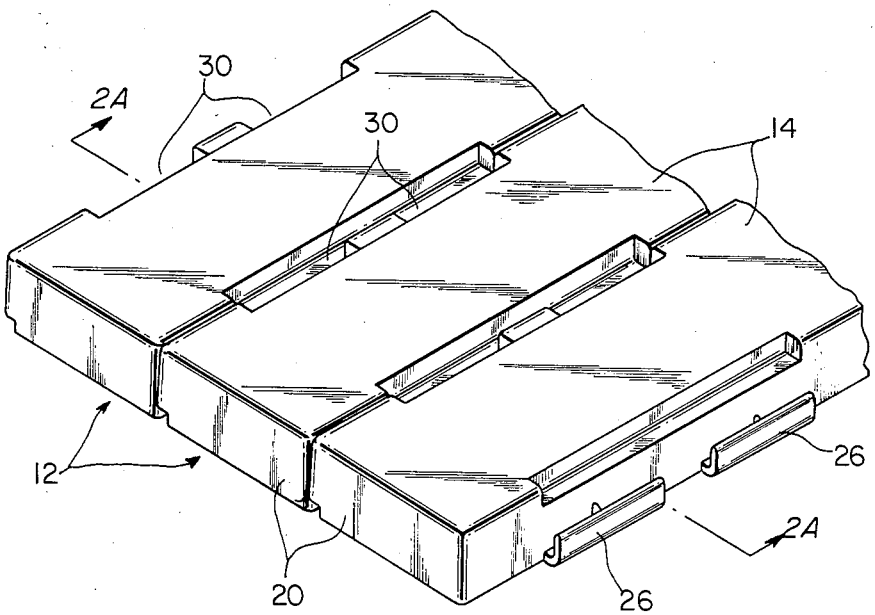
FIG. 2 is a fragmentary perspective view of a plural slat portion of the mattress stiffener assembly, viewed from above, shown in unrolled, substantial planiform disposition for imparting support to a mattress.
Figure 2A:
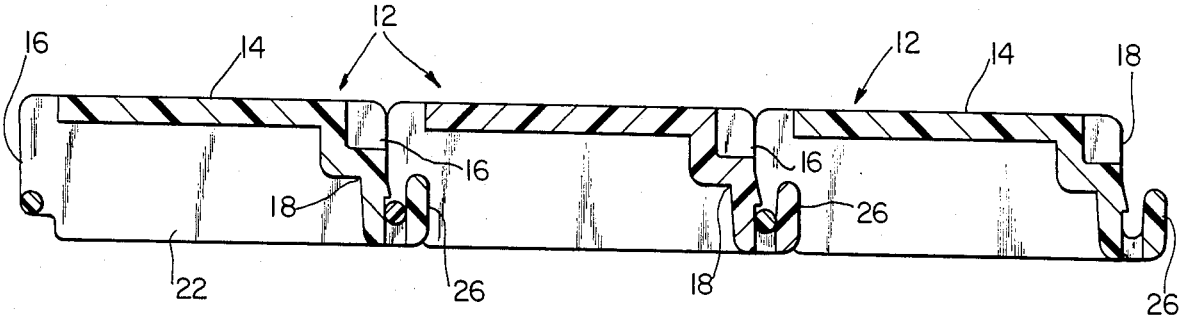
FIG. 2A is a section view at line 2A—2A of FIG. 2.
Figure 3:
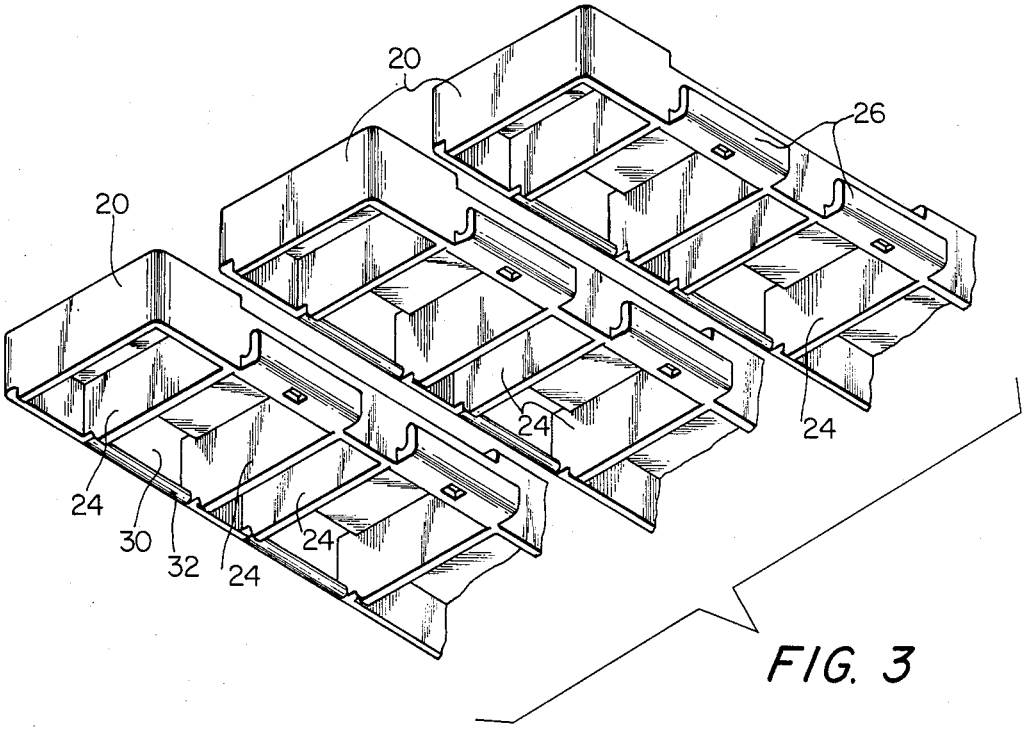
FIG. 3 is a fragmentary perspective view similar to FIG. 2, but viewed from below.
Figure 4:
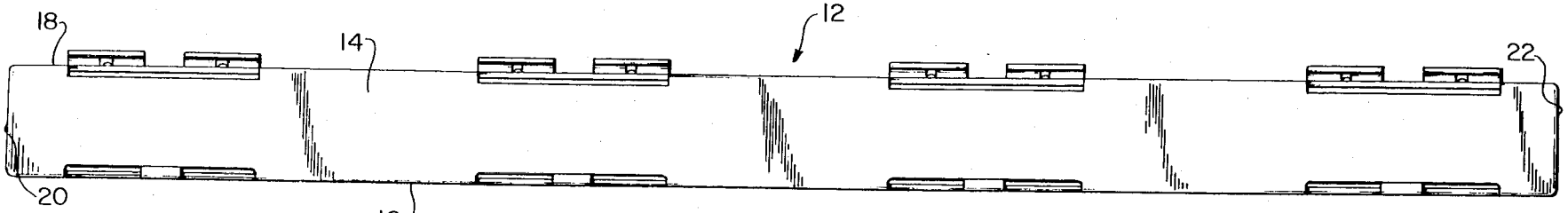
FIG. 4 is a top plan view of one of the slats for the mattress stiffener assembly.
Figure 5:
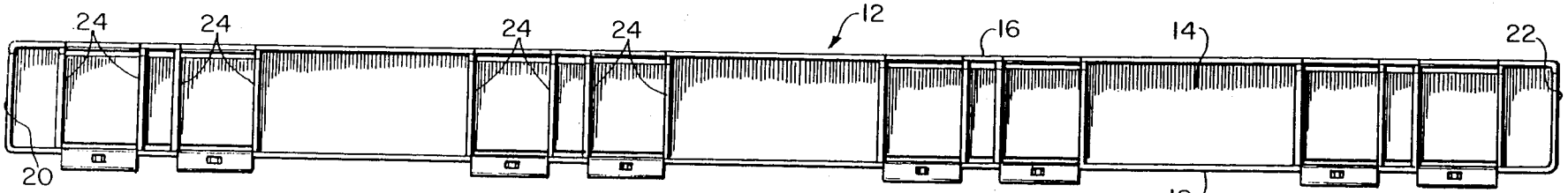
FIG. 5 is a bottom view thereof.

Referring to the drawings, wherein like reference characters designate corresponding parts throughout the several figures, the supplemental support, mattress underlying stiffener of the present invention is indicated generally by the reference character 10 and comprises a plurality of elongated slat members 12 interconnected together to form a compact, lightweight portable and packageable support assembly. This support assembly is designed to fit between the mattress and box spring of a bed, so as to provide supplemental support and added stiffness to the mattress when placed in position to lie beneath the user's upper body portion. Preferably, the slat members 12 are fabricated of molded plastic modules which hinge together, permitting the assembly of molded modular slats forming the mattress supplmental stiffener to be rolled up for carrying and opened out flat to provide support similar to that of a typical "bed board". The slat members 12, in one satisfactory example, may have a length of about 20 inches, and a width of about one and a half inches, with a height of about ⅝th inch, providing a thin, essentially box-shaped modular slat having a top wall 14, which is disposed substantially horizontally in use position, a front side wall 16, a rear side wall 18, and opposite vertical end walls 20 and 22. A plurality of fore-and-aft, vertical interior stiffener webs 24 are also provided, for example, at the positions shown.

The modular molded slat members 12 are providing along the lower edges of the rear walls 18 with essentially right angular protruding hook formations 26 defining one section of a pair of interconnecting hinge means. These hook formations 26 are provided, in one preferred embodiment, in associated pairs located near each of the ends 20 and 22 of each slat member and at selected intervening locations therebetween. The hook formation 26, as shown, comprises an apertured lower leg **26*a* having a slot-like aperture 26*b* therein, and having an upwardly extending leg or lip portion 26*c* terminating in a rounded upper edge as shown. Coactive with the hook formation 26 is a generally right-angle shaped inclined ramp and shoulder formation 28 located adjacent the midportion of the lip-forming vertical leg 26*c* and protruding from the rear side wall 18 a short distance into the space between the principal plane of the outer face of rear side wall 18 and the lip formation 26*c***.

The opposite or front side wall 16 of each slat member is provided with pairs of rectangular openings 30 therein which are bounded at their lower edges by a rounded rod formation 32 shaped and sized to be received in the latching recess **26*d* defined between the confronting surfaces of the rear side wall 28 and lip-forming vertical leg 26*c* and between the lower horizontal leg 26*a* of the hook formation and the shoulder portion 28*a* of the restraining nose formation 28 provided at each hook formation 26. The uppermost portion of each opening 30 in the front side wall 16 of each slat member includes a portion extending into the adjoining parts of the side wall 14 by a cut-out 30*a* in the top wall 14**.

In one preferred embodiment, a sufficient number of the molded modular slats 12, for example 26 slats, are interconnected to form a mattress stiffener of about 20 inches by 40 inches total dimension when arranged in a flat, substantially planiform array, and is to be located between the mattress and box spring at a location to underlie the upper body portion of the user when lying on the mattress. In this unrolled, substantially flat use position, the exterior flat face of the portions of the front wall 16 of each modular slat, except for the interruptions formed by the openings 30, abut the similar flat exterior surfaces of the rear wall 18, while the rod formations 32 are restrained in the recesses **26*d* therefor of the hook formations 26 by the nose formation 28, thus tending to resist deformation of the slats from the flat substantially planiform alignment of the modular slats in the unrolled use configuration. However, the hinged-together plurality of modular slats 12 can be rolled up to the rolled conditions shown in FIG. 1, when the assembly of slats is inverted from the normal use position, so that the respective hinged-together modular slats can swing upwardly about the hinge axis to suitable inclined disposition relative to each other to roll the slat assembly into the spiral roll as shown in FIG. 1. The roll can then be restrained, if desired by straps 36 having, for example, mating hook and loop type fastener portions indicated at 38 at one end thereof and loops 40** at the other end, to restrain the bed stiffener in rolled up condition.

I claim:

1. A portable mattress stiffener for forming a generally rectangular supplemental support panel assembly for bed mattresses adapted to be placed between a mattress and underlying box springs or the like, the panel assembly having a longitudinal axis to extend lengthwise of the mattress in use position and comprising a plurality of elongated rigid slat members of relatively thin, generally rectangular cross-sectional configuration each having a flat top wall and first and second side walls arranged in side-wall-abutting parallel relation in use position forming a rectangular panel, the slat members having longitudinal axes extending in parallelism transversely perpendicular to said longitudinal axis, hinge means interconnecting the respective slat members with each other at a lower edge of said side walls opposite an upper side wall edge adjoining said top wall and disposed at plural locations spaced longitudinally along said side walls of each of said slat members, the hinge means comprising interfitting first and second hinge formations, the first hinge formations being integrally formed along said first side and protruding beyond the face thereof defining an upwardly opening recess and the second hinge formations being provided at corresponding spaced locations along said lower side wall edge of the second side wall of each slat member and comprising a companion hinged formation interfitted in said recess defined by the first hinge formation, the interfitted hinge formations providing hinge axes at said lower edge of the said walls whereby the respective slat members are permitted to pivot about said hinge formation to arrange the slat members in a spiral roll disposition with the slat members angularly disposed relative to each other for transport, and said side walls of adjacent slat members forming abutment surfaces abutting each other when the assembly is unrolled to a flat use disposition to resist deformation of the slat members from a predetermined substantially uniform relationship with said hinge axes located adjacent the lower edges of the abutting side wall surfaces.

2. A portable mattress stiffener as defined in claim 1, wherein said first hinge formations each comprise a generally L-shaped hook formation protruding beyond the face of said first side wall of each slat member, each L-shaped hook formation having an outwardly projecting lower leg portion extending from the first side wall and an outer leg portion perpendicular thereto paralleling the first side wall and defining said upwardly opening recess therebetween.

3. A portable mattress stiffener as defined in claim 2, wherein said second hinge formation comprises a rod portion at plural locations along said second side wall at positions to register with said first hinge formations and said second side walls having adjacent recess means at said rod portions receiving said L-shaped hook formations through said second side walls for reception of said rod portions in said upwardly opening recesses.

4. A portable mattress stiffener as defined in claim 3, wherein said first side wall of each slat member additionally comprises a ramp-like releasable restraining formation adjacent an upwardly opening entry throat into each said upwardly opening recess for restraining said rod portion of said second hinge formations in said recess.

5. A portable mattress stiffener as defined in claim 4, wherein each of said slat members is a molded body of downwardly opening rectangular box-like configuration defining said top wall and first and second side walls, the side walls being parallel to each other and perpendicular to said top wall, and each slat member including a plurality of reinforcing web-like ribs integrally joined to the top wall and first and second side walls and extending in parallel planes perpendicular to said walls.

6. A portable mattress stiffener as defined in claim 5, wherein said web-like reinforcing ribs are rectangular partition formations having vertical and horizontal edges corresponding substantially to the height of said side walls and width of said top walls respectively, and said partition formations being located in substantially flanking relation at opposite sides of each of said recess means in the second side wall adjacent said rod portions.

7. A portable mattress stiffener as defined in claim 3, wherein each of said slat members is a molded body of downwardly opening rectangular box-like configuration defining said top wall and first and second side walls, the side walls being parallel to each other and perpendicular to said top wall, and each slat member including a plurality of reinforcing web-like ribs integrally joined to the top wall and first and second side walls and extending in parallel planes perpendicular to said walls.

8. A portable mattress stiffener as defined in claim 7, wherein said web-like reinforcing ribs are rectangular partition formations having vertical and horizontal edges corresponding substantially to the height of said side walls and width of said top walls respectively, and said partition formations being located in substantially flanking relation at opposite sides of each of said recess means in the second side wall adjacent said rod portions.

9. A portable mattress stiffener as defined in claim 2, wherein said first side wall of each slat member additionally comprises a ramp-like releasable restraining formation adjacent an upwardly opening entry throat into each said upwardly opening recess for restraining the companion hinge formation of said second hinge formations in said recess.

10. A portable mattress stiffener as defined in claim 2, wherein each of said slat members is a molded body of downwardly opening rectangular box-like configuration defining said top wall and first and second side walls, the side walls being parallel to each other and perpendicular to said top wall, and each slat member including a plurality of reinforcing web-like ribs integrally joined to the top wall and first and second side walls and extending in parallel planes perpendicular to said walls.

11. A portable mattress stiffener as defined in claim 10, wherein said web-like reinforcing ribs are rectangular partition formations having vertical and horizontal edges corresponding substantially to the height of said side walls and width of said top walls respectively, and said partition formations being located in substantially flanking relation at 12. A portable mattress stiffener as defined in claim 1, wherein said second hinge formation comprises a rod portion at plural locations along said second side wall at positions to register with said first hinge formations and said side walls having adjacent recess means at said rod portions receiving portions of the first hinge formations through said second side-walls for reception of said rod portions in said upwardly opening recesses.

13. A portable mattress stiffener as defined in claim 1, wherein each of said slat members is a molded body of downwardly opening rectangular box-like configuration defining said top wall and first and second side walls, the side walls being parallel to each other and perpendicular to said top wall, and each slat member including a plurality of reinforcing web-like ribs integrally joined to the top wall and first and second side walls and extending in parallel planes perpendicular to said walls.

14. A portable mattress stiffener as defined in claim 13, wherein said web-like reinforcing ribs are rectangular partition formations having vertical and horizontal edges corresponding substantially to the height of said side walls and width of said top walls respectively, and said partition formations being located in substantially flanking relation at opposite sides of each of said companion hinge formations.

* * * * *

UNITED STATES PATENT AND TRADEMARK OFFICE

Certificate

Patent No.: 4,815,155 Patented: March 28, 1989

On petition requesting issuance of a certificate for correction of inventorship pursuant to 35 U.S.C. 256 it has been found that the above-identified patent, through error and without any deceptive intent, improperly sets forth the inventorship. Accordingly, it is hereby certified that the correct inventorship of this patent is:
Clayton L. Sommers, Ravi Sawhney and Donald A. Brown.

Signed and Sealed thid Twentieth Day of February, 1990

GARY L. SMITH

*Supervisory Patent Examiner*
*Art Unit 358*